US009677351B2

(12) United States Patent
Robichaux et al.

(10) Patent No.: US 9,677,351 B2
(45) Date of Patent: Jun. 13, 2017

(54) METHOD AND APPARATUS FOR ANCHORING CASING AND OTHER TUBULAR GOODS

(71) Applicant: BLACKHAWK SPECIALTY TOOLS, LLC, Houston, TX (US)

(72) Inventors: Ron D. Robichaux, Houma, LA (US); Thad Scott, Houston, TX (US); James G. Martens, Houston, TX (US); J. Christopher Jordan, Jr., Houston, TX (US)

(73) Assignee: Blackhawk Specialty Tools, LLC, Houston, TX (US)

( * ) Notice: Subject to any disclaimer, the term of this patent is extended or adjusted under 35 U.S.C. 154(b) by 283 days.

(21) Appl. No.: 14/029,912

(22) Filed: Sep. 18, 2013

(65) Prior Publication Data

US 2014/0076583 A1 Mar. 20, 2014

Related U.S. Application Data

(60) Provisional application No. 61/702,331, filed on Sep. 18, 2012.

(51) Int. Cl.

| | |
|---|---|
| ***E21B 19/06*** | (2006.01) |
| ***E21B 33/14*** | (2006.01) |
| ***E21B 19/24*** | (2006.01) |

(52) U.S. Cl.

CPC ..... *E21B 19/06* (2013.01); *E21B 19/24* (2013.01); *E21B 33/14* (2013.01)

(58) Field of Classification Search

CPC ..... E21B 4/18; E21B 17/10; E21B 17/1057; E21B 17/1085; E21B 19/24; E21B 23/01

USPC ..... 166/85.5, 241.6

See application file for complete search history.

(56) References Cited

U.S. PATENT DOCUMENTS

| | | | | |
|---|---|---|---|---|
| 1,960,728 | A * | 5/1934 | Cannon | E04B 1/4164 52/699 |
| 5,018,749 | A * | 5/1991 | Forch | F16J 15/3456 277/369 |
| 5,586,466 | A * | 12/1996 | Steiner | G01F 23/30 73/311 |
| 7,918,270 | B2 * | 4/2011 | Schiefelbein, Jr. | E21B 17/1035 166/75.11 |
| 9,181,761 | B2 * | 11/2015 | Hafernik | E21B 19/002 |

(Continued)

*Primary Examiner* — Blake Michener
*Assistant Examiner* — Manuel C Portocarrero
(74) *Attorney, Agent, or Firm* — Ted M. Anthony

(57) ABSTRACT

An anchor assembly for anchoring casing or other pipe against axial upward movement while permitting rotation of the casing or other pipe. An inner mandrel member has a central bore and a flange member extending around the outer circumference of the mandrel. A friction reducing ring member is located on an upper surface of the flange member, while layered friction reducing sleeve members are positioned around the outer surface of the mandrel member. An anchor sleeve member is concentrically and rotatably positioned around the outer surface of the outermost friction reducing sleeve member. Connection flanges, each having at least one bore for attachment to a shackle or other connecting device, extend laterally from the outer periphery of the anchor sleeve member and allow for anchoring of the assembly (and any attached casing or other pipe) to a rig or other structural support member.

19 Claims, 4 Drawing Sheets

(56) References Cited

U.S. PATENT DOCUMENTS

| | | | | |
|---|---|---|---|---|
| 2003/0121666 | A1* | 7/2003 | Boyd | E21B 33/035 166/341 |
| 2008/0053661 | A1* | 3/2008 | Funk | E21B 19/00 166/380 |
| 2008/0190611 | A1* | 8/2008 | Tjorswaag | E21B 17/05 166/285 |
| 2010/0230116 | A1* | 9/2010 | Harmon | E21B 23/06 166/382 |
| 2012/0298378 | A1* | 11/2012 | McCauley | E21B 23/01 166/382 |
| 2013/0118752 | A1* | 5/2013 | Hannegan | E21B 47/0005 166/336 |
| 2013/0192853 | A1* | 8/2013 | Themig | E21B 33/1216 166/387 |
| 2013/0327532 | A1* | 12/2013 | Ring | E21B 33/05 166/335 |

* cited by examiner

METHOD AND APPARATUS FOR ANCHORING CASING AND OTHER TUBULAR GOODS

CROSS REFERENCES TO RELATED APPLICATIONS

Priority of U.S. Provisional Patent Application Ser. No. 61/702,331, filed Sep. 18, 2012, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a method and apparatus for anchoring casing and/or other tubular goods within a well. More particularly, the present invention pertains to a method and apparatus for anchoring casing in a well during cementing or other pumping operations, while permitting rotation of such anchored casing.

2. Brief Description of the Prior Art

Drilling of an oil or gas well is frequently accomplished using a surface drilling rig and tubular pipe. When installing pipe (or other tubular goods) into a wellbore, such pipe is typically inserted into said wellbore in a number of sections of substantially equal length commonly referred to as "joints". As the pipe penetrates deeper into a wellbore, additional joints of pipe can be added to the ever lengthening pipe "string" at a drilling rig or other surface facility. As such, a typical pipe string comprises a plurality of interconnected sections or joints of pipe having an internal, longitudinally extending bore.

After a wellbore is drilled to a desired depth, relatively large diameter pipe known as casing is typically installed within the wellbore and cemented in place. Cementing is usually performed by pumping a predetermined volume of cement slurry into the well from the surface using high-pressure pumps. The cement slurry is typically pumped down the inner bore of the casing string, out the distal or bottom end of the casing, and back up around the outer surface of the casing. In this manner, the cement slurry leaves the inner bore of the casing and enters the annular space existing between the outer surface of the casing and the inner surface of the wellbore. The cement is allowed to harden, forming a sheath around the outer surface of the casing; this cement sheath beneficially secures the casing in place and forms a seal to prevent fluid flow along the outer surface of the casing string.

Top drive systems are commonly utilized on many drilling rigs to pick up sections of pipe within a derrick, join such pipe together (using threaded connections) and provide torque to such pipe as part of the well drilling process. More recently, such top drive systems have also been used to install casing within wellbores. In this regard, such top drive systems are frequently used in conjunction with so-called casing running tools ("RT's"), which permit casing to be reciprocated and/or rotated during casing installation and cementing operations, thereby generally resulting in better overall cementing performance.

During casing cementing operations, a cement head is typically utilized to provide a connection or interface between a top drive or RT, and a casing string that extends into a well bore. Such cement heads should beneficially permit cement slurry to flow from a pumping assembly into a well, and should have sufficient flow capacity to permit high pressure pumping of large volumes of cement and other fluids at high flow rates.

Darts, balls, plugs and/or other objects, typically constructed of rubber, plastic or other material, are frequently pumped into a well in connection with cementing operations. In many instances, such items are suspended within a cement head until the objects are released or "launched" at desired points during the cement pumping process. Once released, such items join the cement slurry flow and can be pumped down hole directly into a well. Such darts, balls, plugs and/or other objects should be beneficially held in place within the slurry flow passing through the cement head prior to being launched or released without being damaged or washed away by such slurry flow.

During casing installation operations, and especially during cement pumping operations, casing can be forced in an axially upward direction. Buoyancy forces of cement slurry, as well as pumping forces, can all act on a casing string in a well, overcoming the weight of the casing string and driving such casing string in an axially upward direction. Such upward movement by a casing string can create a number of problems including, without limitation, poor cement placement and/or bonding between the outer surface of a casing string and the inner surface of a wellbore. Such upward movement can also lead to the creation of channels and/or so-called "micro-annuluses" between casing and a cement sheath.

It is common practice to attempt to anchor casing against axial movement by connecting such casing to a blowout preventer assembly, rig structure or other secure anchor point(s) using chains, cables or other similar attachment means. However, such practice can create undesirable safety risks for personnel who must manipulate and connect such chains, cables and/or other attachment means to a casing string or attached components, frequently when there are no convenient or effective attachment points on said casing and/or related components. Moreover, such conventional attachment means often cannot be securely connected and are at risk of slipping or becoming disconnected when subjected to loading. Importantly, once casing is anchored in place, such conventional anchoring means prevent rotation of such casing, thereby negating important benefits flowing from the ability to rotate the casing.

Thus, there is a need for a means for conveniently and efficiently anchoring casing in place (including, without limitation, large diameter and heavy surface casing) during casing installation and cementing operations to offset upward forces acting on said casing. Further, such anchoring means should permit such casing to be rotated during the cementing process, and should not impede the launching of darts, balls, plugs and/or other objects.

SUMMARY OF THE INVENTION

The present invention comprises a method and apparatus for anchoring casing or other tubular goods in place, such as during casing installation and cementing operations, that permits such casing or other tubular goods to be rotated. The present invention permits the application of downward force on a casing string to offset upward forces acting on such casing including, without limitation, during pumping operations.

In a preferred embodiment, an anchor assembly of the present invention comprises a mandrel member having a central bore extending through said mandrel member. The inner diameter of said central bore of said mandrel member is beneficially sized such that it can be concentrically disposed around the outer surface of a section of pipe, while not passing over a pipe collar. Said mandrel member also has a flange member extending around the outer circumference of said mandrel member; a plurality of transverse threaded bores extend through said flange member.

A ring member is disposed on the upper surface of said flange member. Said ring member beneficially has high lubricity resulting in friction reduction qualities. Although any number of different materials having desired qualities can be used for this purpose, in a preferred embodiment said ring member is constructed of polytetrafluoroethylene (marketed under the brand name "Teflon"®). Additionally, in a preferred embodiment, a plurality of layered sleeve members is disposed around the outer surface of at least a portion of said mandrel member. Said sleeve members can beneficially have high lubricity providing friction reduction qualities; said sleeve members can be constructed of polytetrafluoroethylene (marketed under the brand name "Teflon"®).

An anchor sleeve member is concentrically and rotatably disposed around the outer surface of the outermost sleeve member. Attachment flanges, each having at least one bore, extend laterally from the outer periphery of said anchor sleeve member. Although other configurations and orientations can be envisioned, said attachment flanges comprise substantially planar wing-like extensions that are phased 180 degrees apart around the outer circumference of said anchor sleeve member. Bores in said attachment flanges provide an attachment point for shackles, chains or other coupling devices. Said mandrel member is free to rotate relative to said anchor sleeve member about an axis that is substantially parallel to the longitudinal axis of said pipe section.

It is to be observed that the anchor assembly of the present invention can be positioned at other locations on a pipe string or tool assembly without departing from the scope or novelty of the present invention. By way of illustration, but not limitation, the anchor assembly of the present invention can be included within a cement head assembly or other surface tool (as opposed to being disposed directly over a pipe section). Similarly, it is also to be observed that friction reducing means can also be employed, as opposed to or in addition to said Teflon rings and/or sleeves, without departing from the scope or novelty of the present invention. By way of illustration, but not limitation, bearings or other friction reducing means can be used between anchor sleeve member and mandrel member in order to facilitate relative rotation of said components.

By maintaining downward force on a pipe string, while still permitting rotation of said pipe string, the anchoring assembly of the present invention provides a number of advantages including, without limitation, improved cement placement and bonding, prevention of void formation in cement columns and reduction/elimination of micro-annulus creation. Moreover, the anchoring assembly of the present invention can be used on large and heavy-walled pipe including, without limitation, large diameter surface casing (including 13⅜" OD casing or larger).

The foregoing summary, as well as the following detailed description of preferred embodiments, is better understood when read in conjunction with the appended drawings. For the purpose of illustrating the invention, the drawings show certain preferred embodiments. It is understood, however, that the invention is not limited to the specific methods and devices disclosed. Further, dimensions, materials and part names are provided for illustration purposes only and not limitation.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
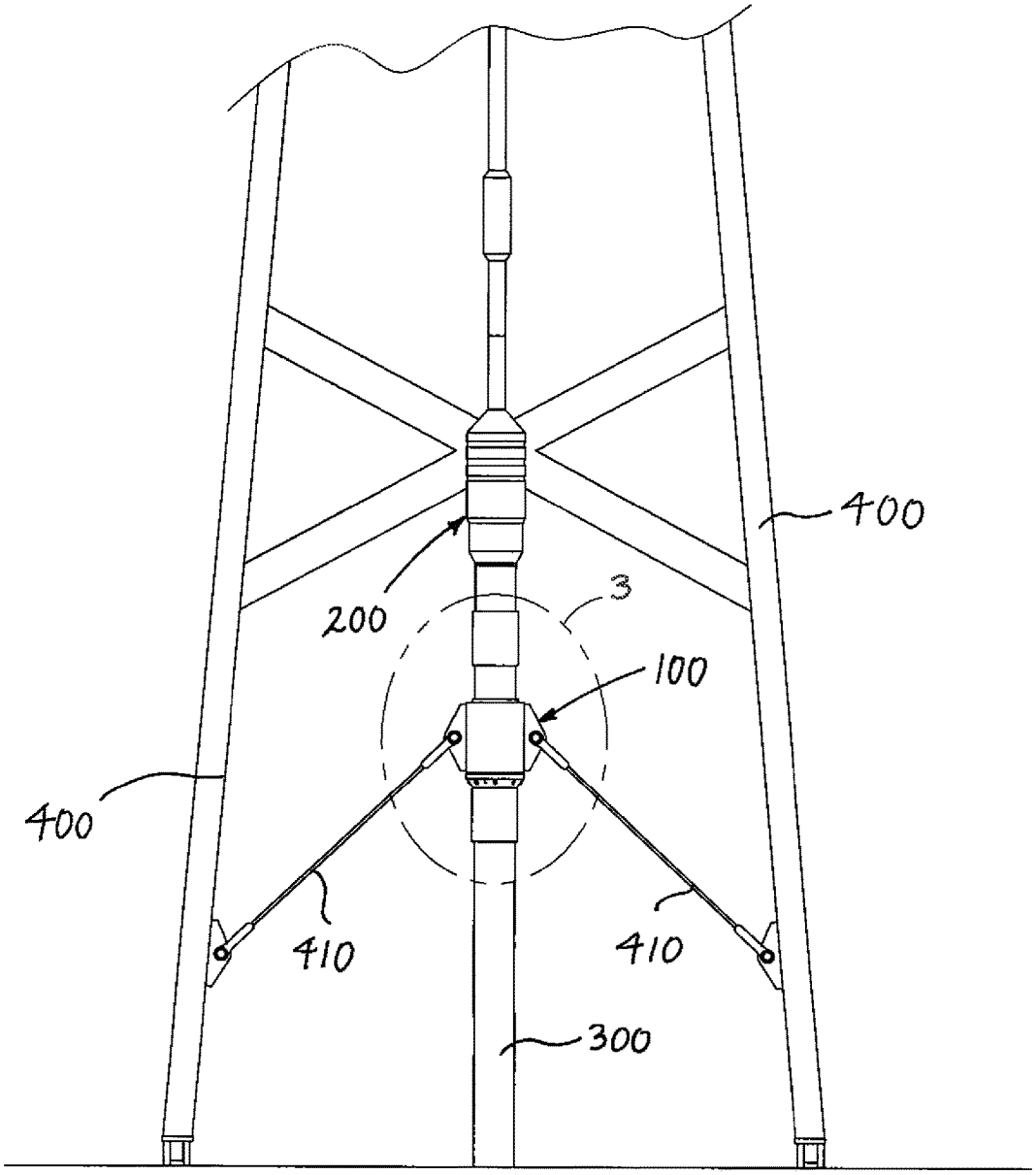
FIG. 1 depicts a side view of an anchor assembly of the present invention installed in connection with a cement head.

FIG. 1 depicts a side view of an anchor assembly 100 of the present invention installed in connection with a cement head assembly 200. Anchor assembly 100 permits pipe section 300 to be conveniently and effectively anchored against upward axial movement by anchoring said pipe 300 to a blowout preventer assembly, rig structure or other secure anchor point(s) using chains, cables or other similar attachment means as more fully described herein. As depicted in FIG. 1, anchor assembly 100 is connected to drilling rig derrick structural members 400 using cables 410. Further, anchor assembly 100 of the present invention permits pipe section 300 to be rotated, such as during a casing cementing process.

Still referring to FIG. 1, although anchor assembly 100 of the present invention is depicted as being installed on a section of pipe 300 below cement head 200, it is to be observed that said anchor assembly 100 can be installed in many different locations or configurations within conventional cementing and/or casing installation tool assemblies. For example, anchor assembly 100 of the present invention can be included as a component within a cement head assembly or other tool assembly (as opposed to being disposed on a pipe section).

Figure 2:
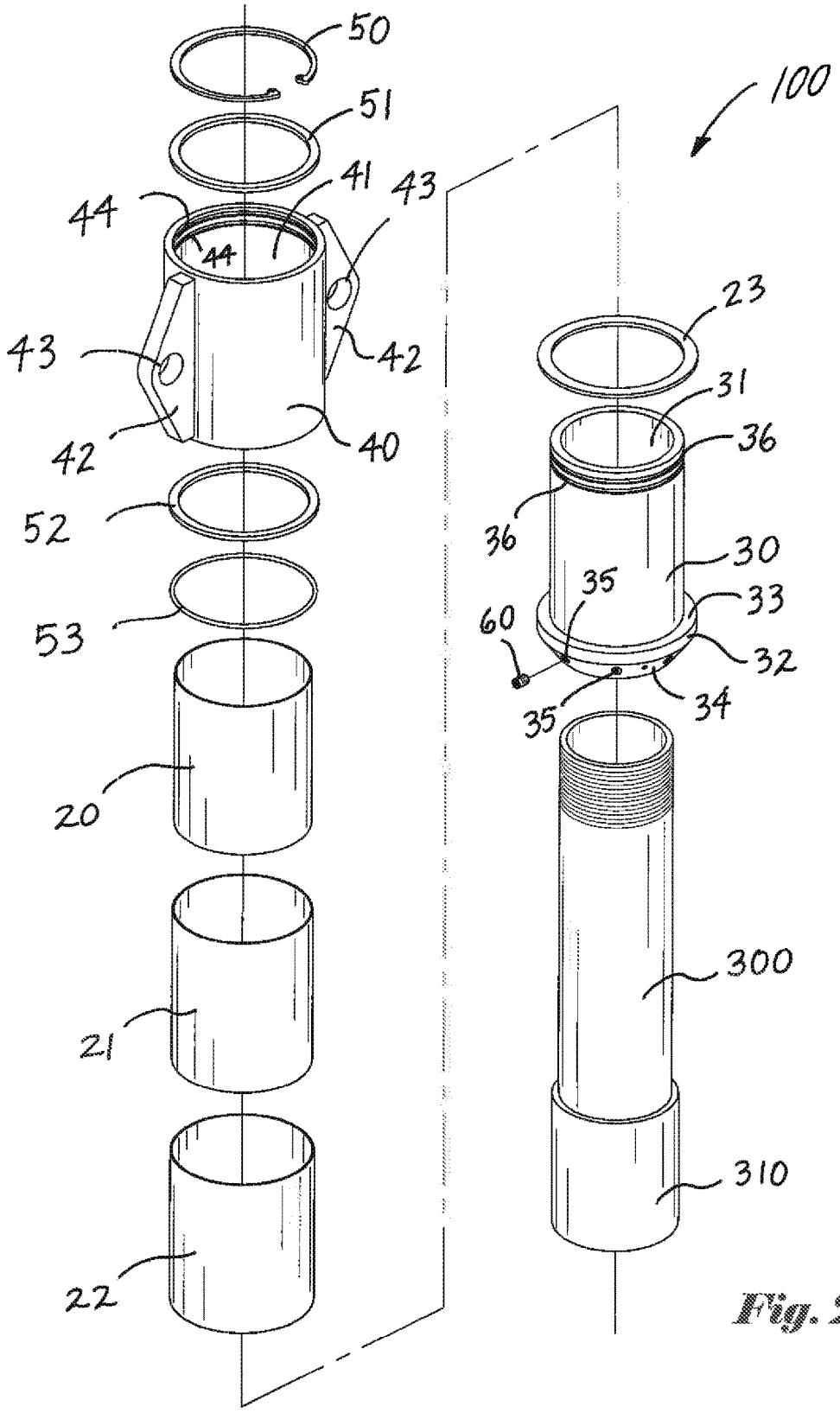
FIG. 2 depicts an exploded view of an anchor assembly of the present invention.

FIG. 2 depicts an exploded view of anchor assembly 100 of the present invention. In a preferred embodiment depicted in FIG. 2, anchor assembly 100 comprises inner mandrel member 30. Said inner mandrel member 30 is substantially cylindrical and has central bore 31 extending through said inner mandrel member 30 to form a sleeve-like member. Said central bore 31 of mandrel member 30 is beneficially sized such that a casing section 300 can be received within said bore 31; put another way, mandrel member 30 can be disposed around the outer surface of said casing section 300. However, the inner diameter of said central bore 31 is less than the outer diameter of collar 310, thereby preventing said mandrel member 30 from passing over said collar 310.

Mandrel member 30 also has flange member 32 that extends around the outer circumference of said mandrel member 30. In a preferred embodiment depicted in FIG. 2, said flange member 32 defines upper shoulder surface 33 and tapered lower surface 34. A plurality of threaded bores 35 are oriented radially inward and extend from the outer surface of flange member 32 to through bore 31. Similarly, at least one optional lubrication port can extend through mandrel member 30 to bore 31. Threaded set screws 60 can be threadably received within said threaded bores 35. Circumferential grooves 36 can extend around the outer surface of said tubular mandrel member 30.

A ring member 23 having a central opening is provided. Said ring member 23 can be beneficially sized so that its central opening will fit over an upper portion of tubular mandrel member 30, but not flange member 32. In this configuration, ring member 23 is disposed on upper shoulder surface 33 of flange member 32. Said ring member 23 beneficially has high lubricity and/or other friction reducing characteristics. Although any number of different materials having desired qualities can be used for this purpose, in a preferred embodiment said ring member 23 is constructed of polytetrafluoroethylene (marketed under the brand name "Teflon"®).

In a preferred embodiment depicted in FIG. 2, first sleeve member 22 is sized to fit over a portion of the outer surface of mandrel member 30. Second sleeve member 21 is sized to fit over the outer surface of first sleeve member 22, while third sleeve member 20 is sized to fit over the outer surface of second sleeve member 21. In this configuration, said first, second and third sleeve members 20, 21 and 22 are layered in concentric orientation. Further, said first, second and third sleeve members 20, 21 and 22, respectively, all beneficially have high lubricity and/or other friction reducing characteristics. Although any number of different materials having desired qualities can be used for this purpose, in a preferred embodiment all of said sleeve members 20, 21 and 22, or some combination thereof, are beneficially constructed of polytetrafluoroethylene (marketed under the brand name "Teflon"®).

Still referring to FIG. 2, anchor sleeve 40 has central bore 41 extending through said anchor sleeve. Said anchor sleeve member 40 is disposed around the outer surface of third sleeve member 20; that is, said sleeve member 20 is rotatably received within central bore 41 of sleeve member 40. In a preferred embodiment, attachment flanges 42, each having bores 43, extend laterally from the outer surface of said anchor sleeve 40. Circumferential grooves 44 can extend around the inner surface of central bore 41 of anchor sleeve member 40.

Although other configurations and orientations can be envisioned, said attachment flanges 42 comprise substantially planar wing-like extensions that are phased 180 degrees apart around the outer circumference of anchor sleeve member 40. Bores 43 each provide an attachment point for shackles, chains and/or other coupling devices. Mandrel member 30 (as well as sleeve members 20, 21 and 22) is free to rotate within central through bore 41 of anchor sleeve member 40.

Retainer ring 50 and keeper member 51 can be received within grooves 44 disposed on the inner surface of central bore 41 of sleeve member 40. Similarly, wiper seal 52 and o-ring 53 can be received within grooves 36 disposed on mandrel member 30.

Figure 3:
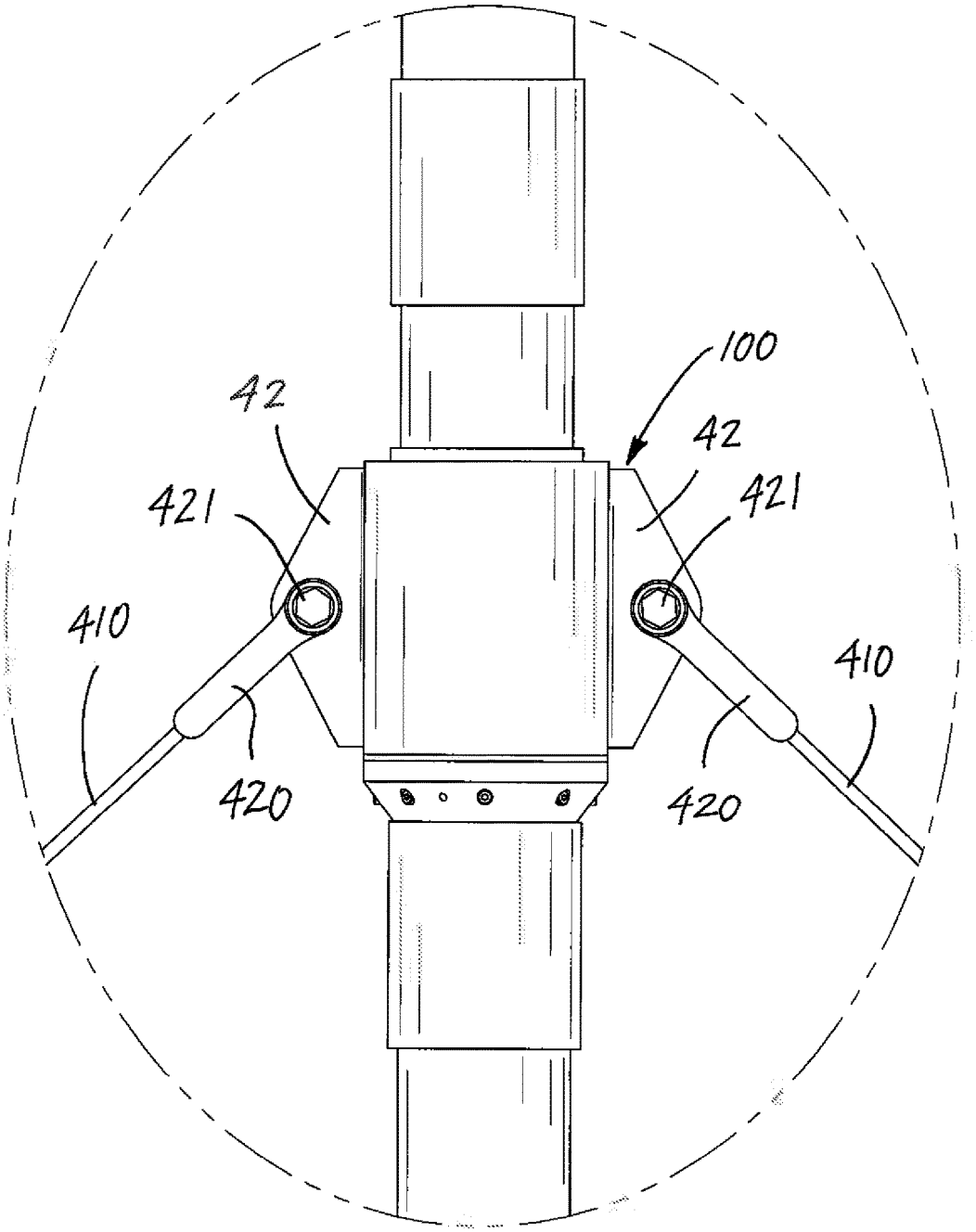
FIG. 3 depicts a detailed view of the highlighted area of FIG. 1.

FIG. 3 depicts a detailed view of the highlighted area depicted in FIG. 1. Shackles 420 having bolts 421 connect to attachment flanges 42; as depicted in FIG. 3, said shackle bolts 421 are received within said bores 43 and secured in place. Said shackles 420 are, in turn, connected to cables 410. As depicted in FIG. 1, the opposite ends of said cables 410 can then be attached to drilling rig derrick members 400 or other location that provides a safe, secure and effective anchoring point. It is to be observed that chains or other strong and effective means can be used for this purpose in place of cables 410 without departing from the scope or novelty of the present invention.

Figure 4:
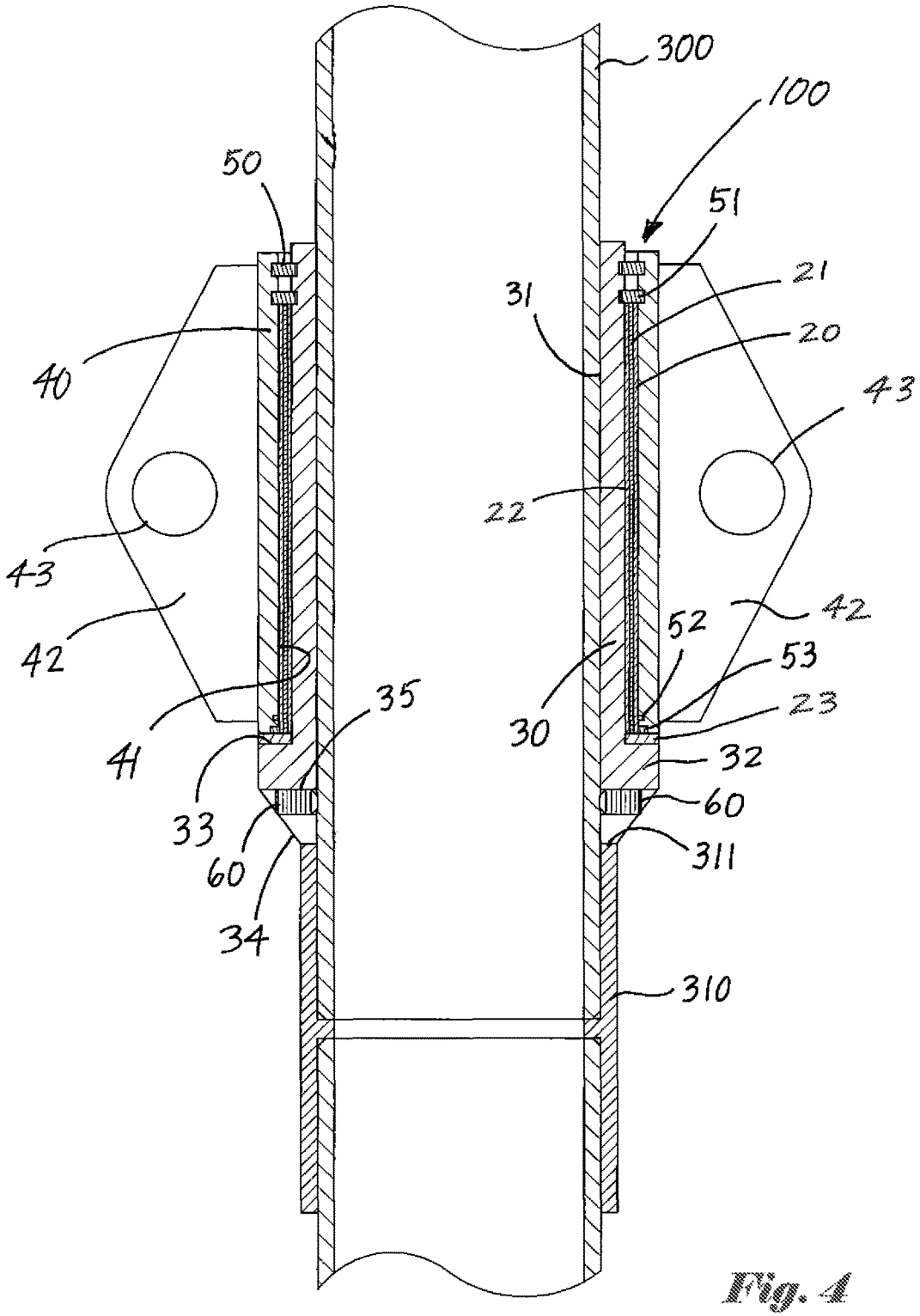
FIG. 4 depicts a side sectional view of an anchor assembly of the present invention.

FIG. 4 depicts a side sectional view of anchor assembly 100 of the present invention. Anchor assembly 100 comprises inner mandrel member 30 having central bore 31 extending through said inner mandrel member 30. The inner diameter of said central bore 31 of mandrel member 30 is beneficially sized such that pipe (casing) section 300 can be received within said bore 31; however, said central bore 31 cannot pass over increased diameter of pipe (casing) collar 310. As depicted in FIG. 4, mandrel member 30 is disposed around the outer surface of said pipe section 300, and above the upper surface 311 of pipe collar 310.

Inner mandrel member 30 also has flange member 32 extending around the outer circumference of said mandrel member 30. In a preferred embodiment depicted in FIG. 4, said flange member 32 defines upper shoulder surface 33 and tapered lower surface 34. A plurality of threaded bores 35, oriented radially inward, extend from the outer surface of flange member 32 to through bore 31. Threaded set screws 60 can be threadably received within said threaded bores 35; when inwardly tightened, said set screws 60 can secure mandrel member 30 to pipe section 300 around the periphery of said mandrel member 30.

Ring member 23 having a central opening is beneficially sized so that it will not fit over flange member 32. As such, as depicted in FIG. 4, ring member 23 is disposed on upper shoulder surface 33 of said flange member 32. Said ring member 23 beneficially has high lubricity and/or other friction reducing characteristics. Although any number of different materials having desired qualities can be used for this purpose, in a preferred embodiment said ring member 23 is constructed of polytetrafluoroethylene (marketed under the brand name "Teflon"®).

First sleeve member 20, second sleeve member 21 and third sleeve member 22 are layered in concentric orientation. Said first, second and third sleeve members 20, 21 and 22, respectively, all beneficially have high lubricity and/or other friction reducing characteristics. Although any number of different materials having desired qualities can be used for this purpose, in a preferred embodiment all of said sleeve members 20, 21 and 22, or some combination thereof, are beneficially constructed of polytetrafluoroethylene (marketed under the brand name "Teflon"®).

Anchor sleeve member 40 has central bore 41 extending through said anchor sleeve member 40. Said anchor sleeve member 40 is disposed around the outer surface of outermost sleeve member 20; said sleeve member 20 is rotatably received within central bore 41 of sleeve member 40. In a preferred embodiment, attachment flanges 42, each having a bore 43, extend laterally from the outer surface of said anchor sleeve 40.

As noted above, although other configurations and orientations can be envisioned, in the embodiment depicted in FIG. 4, attachment flanges 42 comprise substantially planar wing-like extensions phased approximately 180 degrees apart from each other around the outer circumference of anchor sleeve member 40. Bores 43 each provide an attachment point for shackles, chains and/or other coupling devices. Mandrel member 30 (as well as sleeve members 20, 21 and 22) is free to rotate within central through bore 41 of anchor sleeve member 40. Retainer ring 50 and keeper member 51 can be received within grooves 44 disposed on the inner surface of central bore 41 of sleeve member 40, while wiper seal 52 and o-ring 53 can be received within grooves 36 disposed on mandrel member 30.

It is to be observed that the anchor assembly 100 of the present invention can be positioned at other locations on a pipe string or tool assembly without departing from the scope or novelty of the present invention. By way of illustration, but not limitation, anchor assembly 100 of the present invention can be included within a cement head assembly or other surface tool (as opposed to being disposed directly over a pipe section). Similarly, it is also to be observed that friction reducing means can also be employed, as opposed to or in addition to said Teflon rings and/or sleeves, without departing from the scope or novelty of the present invention. By way of illustration, but not limitation, bearings or other friction reducing means can be used between anchor sleeve member and mandrel member in order to facilitate relative rotation of said components.

In all of the embodiments disclosed herein, anchor assembly 100 of the present invention anchors casing (such as pipe 300, which can be attached to a much longer pipe string extending into a wellbore) to resist upward axial forces and prevent upward axial movement of such casing during casing installation and pumping operations.

Although such casing is secured against axial upward movement, anchor assembly 100 of the present invention permits such casing can be rotated even when anchored against upward movement. In many cases, such rotation can improve the quality of casing installation operations, as well as cement placement and bond quality. The method and apparatus of the present invention can be used on large and/or heavy-walled pipe including, without limitation, surface casing having an outer diameter of up to 13⅜" or greater. Further, anchor assembly 100 does not impede the launching of darts, balls, plugs and/or other objects, including from positions above said anchor assembly 100.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An anchor assembly for anchoring a casing string, operationally attached to a cement head positioned above a rig floor, against upward movement out of a wellbore comprising:

a) an anchor sleeve having a central through bore;

b) a mandrel member operationally attached to said cement head and having a central through bore, wherein said mandrel member is rotatably disposed within said central through bore of said anchor sleeve, and wherein said mandrel member and anchor sleeve are positioned above said rig floor and out of said wellbore;

c) a friction reducing material disposed between said anchor sleeve and said mandrel member; and d) an anchor line having a first and a second end, wherein said first end is attached to said to said anchor sleeve and said second end is attached to a drilling rig, and said anchor line restricts said cement head and casing string from upward movement out of said wellbore.

2. The anchor assembly of claim 1, further comprising at least one attachment member extending from said anchor sleeve and adapted to connect said anchor assembly to said first end of said anchor line.

3. The anchor assembly of claim 2, wherein said at least one attachment member further comprises:

a) a first wing member extending from the outer surface of said anchor sleeve and having at least one bore extending through said first wing member; and b) a second wing member extending from the outer surface of said anchor sleeve and having at least one bore extending through said second wing member.

4. The anchor assembly of claim 3, wherein said first and second wing members are phased about one hundred and eighty degrees apart from each other around the outer circumference of said anchor sleeve.

5. The anchor assembly of claim 1, wherein said friction reducing material comprises polytetrafluoroethylene.

6. An anchor assembly for anchoring a casing string against movement out of a wellbore, wherein said casing string is operationally attached to a cement head positioned above a rig floor, comprising:

a) a mandrel member, operationally attached to said cement head, having a first end, a second end, a substantially cylindrical outer surface having a substantially upwardly facing shoulder between said first and second ends, and a central through bore;

b) an anchor sleeve having a central through bore, rotatably disposed around said substantially cylindrical outer surface of said mandrel member between said first end and said shoulder, and wherein said mandrel member and anchor sleeve are positioned above said rig floor and out of said wellbore;

c) a friction reducing material disposed between said anchor sleeve and said mandrel member; and d) an anchor line having a first and a second end, wherein said first end is attached to said to said anchor sleeve and said second end is attached to a drilling rig, and said anchor line restricts said casing string from upward movement out of said wellbore.

7. The anchor assembly of claim 6, further comprising at least one attachment member extending from said anchor sleeve and adapted to connect said anchor assembly to said first end of said anchor line.

8. The anchor assembly of claim 7, wherein said at least one attachment member further comprises:

a) a first wing member extending from the outer surface of said anchor sleeve and having at least one bore extending through said first wing member; and b) a second wing member extending from the outer surface of said anchor sleeve and having at least one bore extending through said second wing member.

9. The anchor assembly of claim 8, wherein said first and second wing members are phased about one hundred and eighty degrees apart from each other around the outer circumference of said anchor sleeve.

10. The anchor assembly of claim 6, wherein said friction reducing material comprises polytetrafluoroethylene.

11. The anchor assembly of claim 10, wherein said friction reducing material comprises at least one polytetrafluoroethylene sleeve disposed around the outer surface of said mandrel member.

12. The anchor assembly of claim 10, wherein said friction reducing material comprises at least one polytetrafluoroethylene ring disposed on said substantially upwardly facing shoulder of said mandrel member.

13. A method for anchoring a tool and associated casing string against upward movement out of a wellbore comprising:

a) attaching an anchor assembly to said tool positioned above a rig floor, said anchor assembly comprising:
   i) an anchor sleeve having a central through bore;
   ii) a mandrel member having a central through bore, wherein said mandrel member is rotatably disposed within said central through bore of said anchor sleeve, and wherein said mandrel member and anchor sleeve are positioned above said rig floor and out of said wellbore;
   iii) a friction reducing material disposed between said anchor sleeve and said mandrel member;
   iv) an anchor line having a first end and a second end, wherein said first end is attached to said anchor sleeve; and b) securing said second end of said anchor line to a drilling rig, wherein said anchor line restricts said casing string from upward movement out of said wellbore.

14. The method of claim 13, further comprising at least one attachment member extending from said anchor sleeve and adapted to connect said anchor assembly to said first end of said anchor line.

15. The method of claim 14, wherein said at least one attachment member further comprises:

a) a first wing member extending from the outer surface of said anchor sleeve and having at least one bore extending through said first wing member; and b) a second wing member extending from the outer surface of said anchor sleeve and having at least one bore extending through said second wing member.

16. The method of claim 15, wherein said first and second wing members are phased about one hundred and eighty degrees apart from each other around the outer circumference of said anchor sleeve.

17. The method of claim 13, wherein said friction reducing material comprises polytetrafluoroethylene.

18. The method of claim 13, wherein said friction reducing material comprises at least one polytetrafluoroethylene sleeve disposed around the outer surface of said mandrel member.

19. The method of claim 13, wherein said friction reducing material comprises at least one polytetrafluoroethylene ring disposed on said substantially upwardly facing shoulder of said mandrel member.

* * * * *